US008011797B2

(12) United States Patent
Rihl

(10) Patent No.: US 8,011,797 B2
(45) Date of Patent: Sep. 6, 2011

(54) BOOM BARRIER

(75) Inventor: Marco Rihl, Salzburg (AT)

(73) Assignee: Skidata AG, Groedig (AT)

( * ) Notice: Subject to any disclaimer, the term of this patent is extended or adjusted under 35 U.S.C. 154(b) by 273 days.

(21) Appl. No.: 12/383,692

(22) Filed: Mar. 26, 2009

(65) Prior Publication Data

US 2009/0244889 A1 Oct. 1, 2009

(30) Foreign Application Priority Data

Mar. 28, 2008 (DE) ..... 10 2008 016 070

(51) Int. Cl.
*F21S 8/00* (2006.01)

(52) U.S. Cl. ..... 362/152; 362/222; 362/249.02; 362/217.14

(58) Field of Classification Search ..... 362/152, 362/219, 222, 217.1, 217.14, 220, 232, 249.02, 362/371
See application file for complete search history.

(56) References Cited

U.S. PATENT DOCUMENTS

| | | | | |
|---|---|---|---|---|
| 6,472,823 | B2 * | 10/2002 | Yen | 315/112 |
| 7,258,461 | B1 | 8/2007 | Izardel | |
| 7,342,510 | B2 * | 3/2008 | Pate | 340/928 |
| 2007/0199243 | A1 * | 8/2007 | Youn | 49/49 |

* cited by examiner

*Primary Examiner* — Evan Dzierzynski
(74) *Attorney, Agent, or Firm* — Karl F. Milde, Jr.; Eckert Seamans Cherin & Mellott, LLC

(57) ABSTRACT

Boom-type barrier (1) comprising a boom (2) mounted on a bracket or stand (3) for movement between open and barring positions. The boom (2) is designed as a tubular member transmissive of light and has therein a band (7) on which are mounted light emitting diodes (6) extending substantially the full length of the boom (2). The light emitting diodes (6) are controlled by an electronics module (12).

11 Claims, 2 Drawing Sheets

BOOM BARRIER

BACKGROUND OF THE INVENTION

The invention relates to a boom barrier having a boom mounted on a bracket or stand for movement between an open and barring (closed) position.

U.S. Pat. No. 7,258,461 discloses a vehicle barrier having a boom with LEDs that emit red and green light so as to indicate the open and barred positions. The LEDs are easily damaged. For this reason, they are fastened on the boom in mutually separated positions and are therefore not clearly visible in their entirety. Also, they are only visible from one side of the boom.

SUMMARY OF THE INVENTION

A principal object of the present invention is to provide an LED-equipped boom which is conspicuously and easily visible.

This object, as well as other objects which will become apparent from the discussion that follows, are achieved, according to the invention, by providing a boom barrier having a tubular member that is transmissive of light. The boom may be a linear continuous tubular member or may comprise two or more tubular sections that are articulated with respect to each other so as to be bendable.

The light-transmissible tubular member may be transparent or opaque; i.e., translucent. Preferably the tubular member consists of a plastic material such as polyester or polycarbonate and, especially, of a fiber-reinforced plastic material.

In accordance with the invention, the band equipped with the light-emitting diodes (LEDs) may comprise a flexible tube or hose or an LED light strip; e.g., a rigid or flexible circuit board. The LEDs may be of a single color but preferably they are multicolored or so-called red/green/blue LEDs or RGB LEDs.

In accordance with the invention, the LED-equipped band extends substantially along the length of the boom; i.e., along at least three quarters of the length thereof. The LEDs may be spaced—e.g., from 1 cm to 10 cm—in the long direction of the boom.

To enable the LED band to be inserted in the tubular boom, at least one end of the latter—i.e., preferably the end thereof opposite the mounting bracket or post—is adapted to be sealed by means of a cap, a plug or the like.

In accordance with the invention, the LEDs are controlled by means of an electronics module. The electronics module is preferably designed to enable the LEDs to be controlled to operate in a variety of modes. Where RGB LEDs are used, the colors may be programmed to be manually adjustable or variable so as to produce the different color operating modes. To this end, the electronics module may be provided with switches or like actuating members. The RGB LEDs may be controlled to emit light of any color desired. Also, the electronics module may control the LEDs to work as chaser lights or to flash.

The boom barrier, according to the invention, may be provided with means for detecting the boom position, to ascertain whether the boom is in the open position, the closed position or any intermediate position. Such means may be integrated into the electronics module, for example.

In this way, a traffic-light mode may be possible. In other words, the LEDs emit red light when the boom is closed and green light when the boom is open. Using the RGB LEDs, a change of color from red via, orange and/or yellow, to green may be possible.

Advantageously, the boom barrier according to the invention has a proximity sensor disposed inside the boom to input signals to the electronic module through the mounting bracket, for example, such as an induction loop embedded in a roadway surface to operate as vehicle proximity sensor.

In this way, it is possible to design the electronics module to control the LEDs in the traffic-light mode—with the aforesaid color-change scheme, if desired—if the proximity sensor detects a vehicle while the LEDs are operating in another color mode as in a company parking lot showing the enterprise's corporate identity colors.

The boom may be mounted on the stand or bracket for horizontal displacement. Normally, it is articulated to the bracket for pivoting about a horizontal axis.

In addition to the LED band, the electronics module may be disposed inside the tubular boom and preferably in a non-visible area thereof; i.e., in the area of the bearing shell which is used to secure the boom on the stud or stub axle of the bracket or stand.

The power supply, such as a battery, may be disposed inside the boom as well. Preferably, power is supplied to the electronics module inside the boom through the bracket or stand. To this end, the stub shaft may be provided on the end face turned towards the bearing shell with a power supply board to which the external power leads are connected, with the power supply board communicating through contacts with a control board disposed in the opposite face end of the bearing shell.

The contacts may be formed as sectors of a circle relative to the pivoting axis, or as sectors of a circle on one of the circuit boards, for example. They may be spring-biased contact pins in point form, for example, on the other circuit boards, such as the power supply board.

It is equally possible to provide the electronics module in or on the bracket or stand, which is advantageous in that the electronics module will not be damaged if the boom is destroyed by a vehicle, for example.

In this case, the power supply board and the control board may have additional contacts to control the LEDs inside the boom by means of the electronics module housed in the bracket.

For a full understanding of the present invention, reference should now be made to the following detailed description of the preferred embodiments of the invention as illustrated in the accompanying drawings.

DESCRIPTION OF THE PREFERRED EMBODIMENTS

Figure 1:
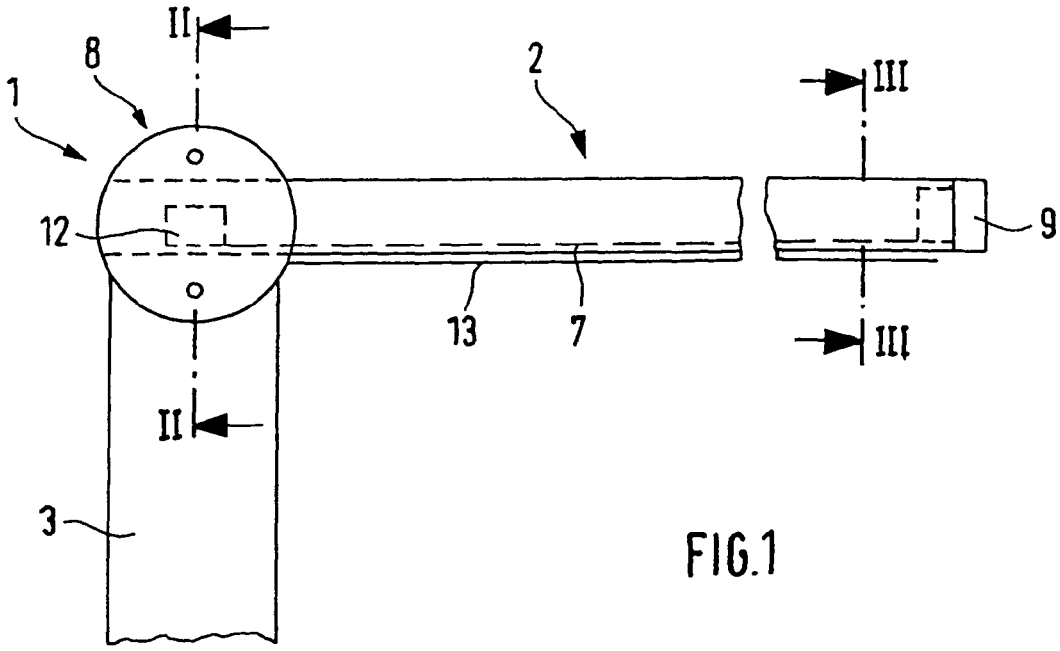
FIG. 1 is a front view of a barrier with the boom in the closed position and having portions broken away.

The preferred embodiments of the present invention will now be described with reference to FIGS. 1-5 of the drawings. Identical elements in the various figures are designated with the same reference numerals.

Figure 2:
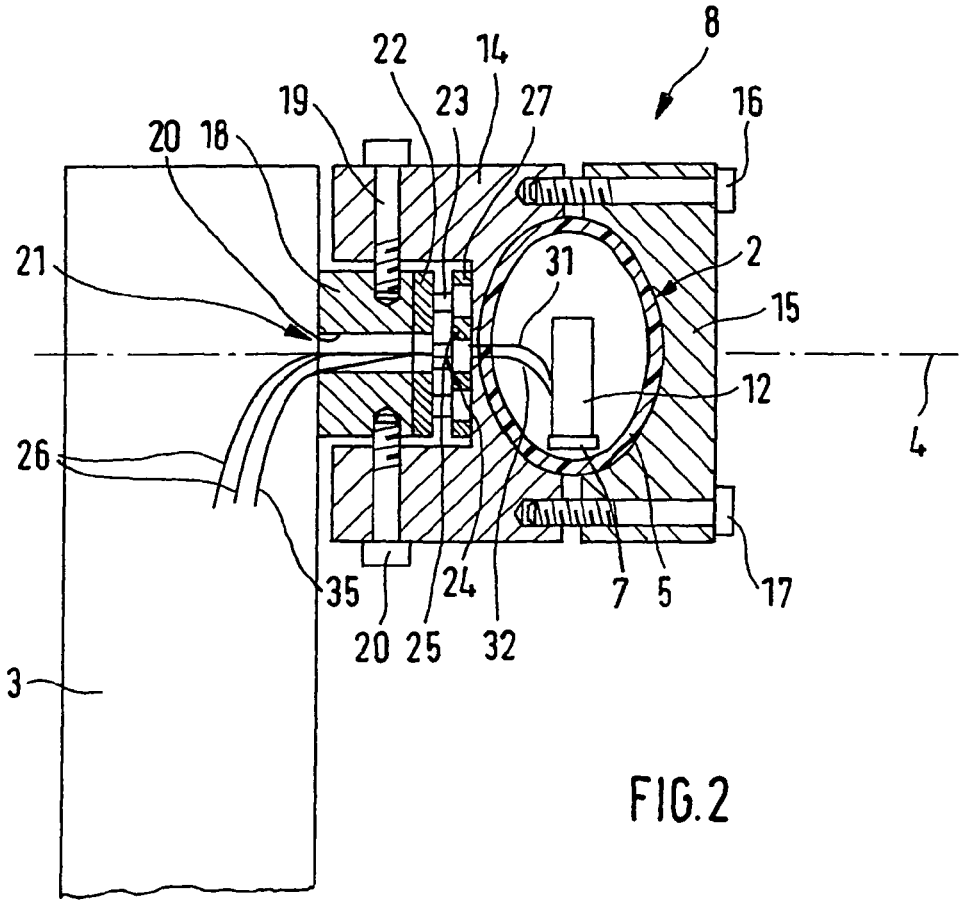
FIG. 2 is a section through the boom and its mounting structure, taken along the line II-II of FIG. 1.
Figure 3:
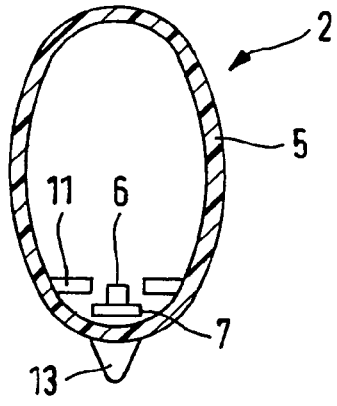
FIG. 3 is a section taken along the line III-III of FIG. 1.
Figure 4:
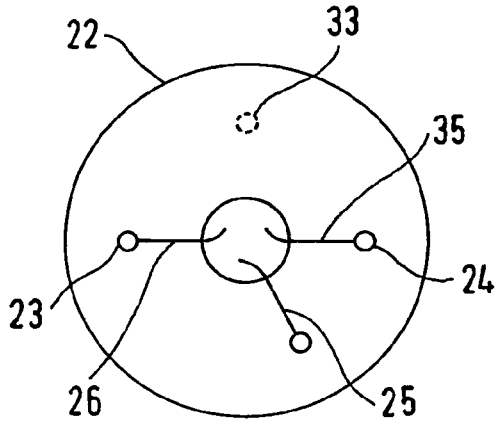
FIGS. 4 and 5 are plan views of the power supply board and the contact board, respectively, of the structure shown in FIG. 2.
Figure 5:
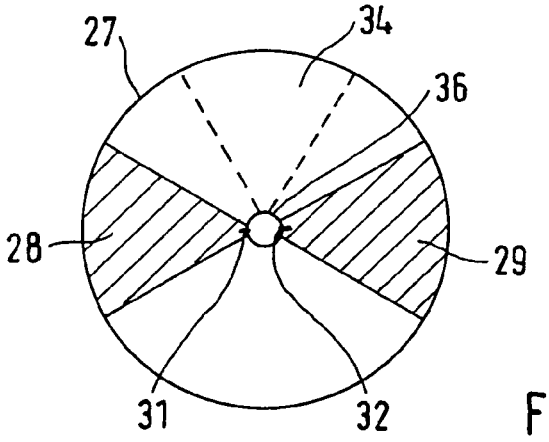

In accordance with FIGS. 1 to 3, barrier 1 comprises a boom 2 mounted on a stand or bracket 3 for pivoting about a horizontal axis normal to the direction of vehicle travel. Barrier 1 may be a parking barrier located at the entrance or exit of a parking lot.

Boom 2 has disposed therein a band 7 in the form of a printed-circuit board mounting LEDs 6. The band 7 and the LEDs shown in phantom in FIG. 1 extends the full length of boom 2, i.e., from socket 8, which attaches boom 2 to bracket 3, to the free end of boom 2, which is sealed by means of a plug 9.

Guide 11 is provided in boom 2 for fixing band 7 in place, which guide may be translucent or transparent and be made of the same material as wall 5 of the tubular boom. LEDs 6 in band 7, which may comprise RGB LEDs, are controlled by means of an electronics module 12 housed in the area of socket 8 inside the tubular member forming boom 2. At its bottom, boom 2 has a lip 13 consisting of a rubber-elastic material.

Socket 8 is formed by two shell halves 14, 15 clamping between them the tube of which boom 2 consists. Halves 14, 15 are secured together by threaded bolts 16, 17. Shell half 14 of socket 8 forms the bearing shell by means of which boom 2 is connected non-rotationally to axle or stud 18, which extends into bearing shell 14.

For non-rotating connection are provided threaded bolts 19, 20 extending through bearing shell 14 and stub axle 18 in a radial direction. For opening boom 2, axle or stud 18 is driven by a motor (not shown) housed in bracket 3. On the face end turned towards socket 8, stub shaft 18 mounts a power supply board 22 provided with spring-biased contact pins 23, 24, 25 as shown particularly in FIG. 4. Contacts 23 form the +12V or +24V terminal, contact 25 is grounded and contact 24 is used as a boom fracture sensor. The power supply leads in bracket 3 to contacts 23, 25 are referred to as "26" and are run to board 22 through a coaxial bore 21 in stud 18. The loads from the boom fracture sensor are referred to as "35".

Opposite power supply board 22, bearing shell 14 has therein a printed-circuit contact board 27 having two sector-shaped contacts 28, 29 coaxially disposed on disc-shaped board 27.

Sector-shaped contact 28 communicates with point contact 23 and sector-shaped contact 29 with the pair of point-shaped contacts 24, 25. In other words, in the normal case, contact 29 interconnects contacts 24, 25 of power supply board 22. If boom 2 is displaced by being tilted forwards by a vehicle, for example, the connection is interrupted to signal a boom fracture condition.

Through leads 31, 32, which are run through coaxial opening 36 and an opening aligned therewith in bearing shell 14, contacts 28, 29 are connected with electronics module. With the electronics module disposed in bracket 3, additional contacts 33, 34 (shown in broken lines in FIGS. 4 and 5) are provided on power supply board 22 and contact board 22, respectively, for controlling LEDs 6. Instead of sectors of a circle, other planar shapes of contacts 28, 29, 34 are possible and connected to point contacts 23 to 25 and 33.

There has thus been shown and described a novel boom barrier which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. Boom-type barrier comprising a boom mounted on a bracket for angular movement on a stub shaft between an open and a barring position, respectively: wherein said boom includes a tubular member transmissive of light and has therein a band on which are mounted light emitting diodes extending substantially the full length of the tubular member; wherein said bracket houses an electronics module electrically connected to, and controlling the light emitting diodes; wherein said bracket forms a bearing housing covering said stub shaft which is provided with a contact board and wherein the stub shaft provided with a power supply board for supplying power through said contact board to the electronics module and the light emitting diodes in the boom.

2. Barrier as in claim 1, wherein the light emitting diodes are red/green/blue light emitting diodes adapted to be variously controlled by the electronics module.

3. Barrier as in claim 2, further comprising means, coupled to the electronics module, for detecting the position of the boom and to provide to the electronics module a signal representing the boom position.

4. Barrier as in claim 1, wherein the electronics module is adapted to be controlled by a vehicle proximity sensor.

5. Barrier as in claim 1, wherein at least one end of the boom is sealable and is openable for introducing the band mounted light emitting diodes.

6. Barrier as in claim 1, wherein the power supply board is provided with point contacts.

7. Barrier as in claim 6, wherein the power supply board has an additional contact for sensing a fracture of the boom.

8. Barrier as in claim 1, wherein the contact board is provided with contacts in the shape of sectors of a circle.

9. Barrier as in claim 1, wherein the electronics module is disposed inside the boom.

10. Barrier as in claim 1, wherein the electronics module is disposed inside the bracket and wherein the power supply board has at least one additional contact for controlling the light emitting diodes by means of the electronics module.

11. Barrier as in claim 1, wherein the electronics module is disposed inside the bracket and wherein the contact board has at least one additional contact for controlling the light emitting diodes by means of the electronics module.

* * * * *